US011094159B2

(12) United States Patent
Schmidt-Ellinger

(10) Patent No.: US 11,094,159 B2
(45) **Date of Patent: *Aug. 17, 2021**

(54) STORAGE CONTAINER FOR A STORAGE AND DELIVERY STATION FOR DRUGS

(71) Applicant: CareFusion Germany 326 GmbH, Kelberg (DE)

(72) Inventor: Hardy Schmidt-Ellinger, Gerolstein-Bewingen (DE)

(73) Assignee: CAREFUSION GERMANY 326 GMBH, Kelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/848,242

(22) Filed: Apr. 14, 2020

(65) Prior Publication Data

US 2020/0242878 A1 Jul. 30, 2020

Related U.S. Application Data

(63) Continuation of application No. 16/552,904, filed on Aug. 27, 2019, now Pat. No. 10,672,219, which is a (Continued)

(51) Int. Cl.
*B65B 35/08* (2006.01)
*G07F 17/00* (2006.01)
(Continued)

(52) U.S. Cl.
CPC ..... *G07F 17/0092* (2013.01); *B65B 35/08* (2013.01); *G07F 11/005* (2013.01); *G07F 11/44* (2013.01)

(58) Field of Classification Search
CPC ..... A61J 7/0076; A61J 3/07; B65B 5/103; B65B 5/10; B65B 35/08; G07F 11/44; G07F 11/005; G07F 17/0092
See application file for complete search history.

(56) References Cited

U.S. PATENT DOCUMENTS 3,263,866 A 8/1966 Proctor
4,903,861 A 2/1990 Yuyama
(Continued)

FOREIGN PATENT DOCUMENTS

EP 1617186 1/2006

OTHER PUBLICATIONS

Extended European Search Report for Application No. 16153271.8, dated Jul. 21, 2016, 8 pages excluding machine translation.

*Primary Examiner* — Patrick H Mackey
(74) *Attorney, Agent, or Firm* — Morgan, Lewis & Bockius LLP

(57) ABSTRACT

A storage container for a storage and delivery station for drugs is provided. The storage container includes a retainer for preventing a multiple drug portions from being delivered simultaneously. The storage container includes a housing that surrounds a receiving chamber and has a circular cylindrical section and a base surface, and a separating device disposed rotatably in the circular cylindrical section and having multiple projections and channels. Each projection has a surface, the uppermost points of the surface defining an upper receiver boundary plane. The storage container also includes a retainer with a fastening section and a retaining section, the retaining section preventing entry of the drug portions into a channel aligned with a delivery opening, and at least one cam for removing drug portions from the retaining section, the cam being movable above the upper receiver boundary plane over the retaining section.

19 Claims, 4 Drawing Sheets

Related U.S. Application Data continuation of application No. 16/042,774, filed on Jul. 23, 2018, now Pat. No. 10,453,293, which is a continuation of application No. 15/010,216, filed on Jan. 29, 2016, now Pat. No. 10,028,888.

(51) Int. Cl.
*G07F 11/00* (2006.01)
*G07F 11/44* (2006.01)

(56) References Cited

U.S. PATENT DOCUMENTS

| | | | | |
|---|---|---|---|---|
| 5,219,095 | A | 6/1993 | Shimizu | |
| 5,791,526 | A | 8/1998 | Landais | |
| 5,803,309 | A | 9/1998 | Yuyama | |
| 5,865,342 | A | 2/1999 | Ito | |
| 5,927,546 | A | 7/1999 | Yuyama | |
| 6,256,963 | B1 | 7/2001 | Kim | |
| 6,394,308 | B1 | 5/2002 | Yuyama | |
| 6,497,342 | B2 | 12/2002 | Zhang | |
| 7,258,248 | B2 | 8/2007 | Kim | |
| 7,510,099 | B2 | 3/2009 | Knoth | |
| 7,669,733 | B2 * | 3/2010 | Kim | G07F 11/54 221/265 |
| 8,887,603 | B2 | 11/2014 | Yuyama | |
| 9,181,017 | B2 | 11/2015 | Bae | |
| 9,550,619 | B2 | 1/2017 | Park, IV | |
| 9,663,260 | B2 | 5/2017 | Morita | |
| 9,710,994 | B2 | 7/2017 | Omura | |
| 9,770,391 | B2 | 9/2017 | Park, IV | |
| 10,028,888 | B2 * | 7/2018 | Schmidt-Ellinger | B65B 35/08 |
| 10,453,293 | B2 * | 10/2019 | Schmidt-Ellinger | G07F 11/005 |
| 2004/0188456 | A1 | 9/2004 | Arai | |
| 2007/0034084 | A1 | 2/2007 | Shertok et al. | |
| 2015/0217929 | A1 * | 8/2015 | Morita | B65B 35/08 221/265 |

* cited by examiner

STORAGE CONTAINER FOR A STORAGE AND DELIVERY STATION FOR DRUGS

CROSS-REFERENCES TO RELATED APPLICATION

This is a continuation of U.S. application Ser. No. 16/552,904, filed Aug. 27, 2019, entitled "STORAGE CONTAINER FOR A STORAGE AND DELIVERY STATION FOR DRUGS," which issued as U.S. Pat. No. 10,672,219 on Jun. 2, 2020, which is a continuation of U.S. application Ser. No. 16/042,774, filed Jul. 23, 2018, entitled "STORAGE CONTAINER FOR A STORAGE AND DELIVERY STATION FOR DRUGS," which issued as U.S. Pat. No. 10,453,293 on Oct. 22, 2019, which is a continuation of U.S. application Ser. No. 15/010,216 filed Jan. 29, 2016, entitled "STORAGE CONTAINER FOR A STORAGE AND DELIVERY STATION FOR DRUGS," which issued as U.S. Pat. No. 10,028,888 on Jul. 24, 2018, all of which are herein incorporated by reference in their entirety.

BACKGROUND

The present disclosure relates to a storage container for drugs, and in particular a storage container for a storage and delivery station for drugs.

Modern automatic blister packaging machines, such as are disclosed for example in WO 2013/034504 A1, depending upon the configuration, include several hundred storage and delivery stations. In each of these a plurality of drug portions of a specific drug is typically stored, and individual drug portions can be delivered on demand. The blister packaging machine typically assembles and blister-packs the drug portions stored in the storage and delivery station for an individual patient according to the administration times prescribed by a doctor.

In many medical treatment settings, it is desirable to provide a storage container, wherein it is ensured that all the drug portions stored in the storage container can be delivered.

SUMMARY

One or more disclosed embodiments provide a storage container for a storage and delivery station for drug portions, including a housing defining a receiving chamber for drug portions, the housing including a circular cylindrical section and a delivery opening for dispensing the drug portions, a separating device rotatably disposed in the circular cylindrical section of the housing, the separating device having a plurality of spaced apart projections disposed on an outer surface and defining channels to receive the drug portions therebetween, wherein uppermost points of adjacent surfaces of the projections define an upper receiver boundary plane, and a cam disposed above the upper receiver boundary plane and configured to remove drug portions from a retaining section of a retainer, the cam having a planar surface.

One or more disclosed embodiments provide for a storage and delivery station for drug portions, including a housing defining a receiving chamber for drug portions, the housing comprising a circular cylindrical section and a delivery opening for dispensing the drug portions, a separating device rotatably disposed in the circular cylindrical section of the housing, the separating device having a plurality of spaced apart projections disposed on an outer surface and defining channels to receive the drug portions therebetween, wherein uppermost points of adjacent surfaces of the projections define an upper receiver boundary plane, and a cam disposed above the upper receiver boundary plane and configured to remove drug portions from a retaining section of a retainer, the cam having at least one angled end face.

One or more disclosed embodiments provide for a storage container for a storage and delivery station for drug portions, including a housing defining a receiving chamber for drug portions, the housing comprising a circular cylindrical section and a delivery opening for dispensing the drug portions, a separating device rotatably disposed in the circular cylindrical section of the housing, the separating device having a plurality of spaced apart projections disposed on an outer surface and defining channels to receive the drug portions therebetween, wherein uppermost points of adjacent surfaces of the projections define an upper receiver boundary plane, and a cam movably disposed above the upper receiver boundary plane over a retaining section of a retainer, the cam configured to remove drug portions from the retaining section.

The foregoing has outlined generally the features of the present disclosure in order that the detailed description that follows can be better understood. Additional features and advantages of the disclosure will be described hereinafter, which form the subject of the claims.

BRIEF DESCRIPTION OF THE DRAWINGS

The device according to the present disclosure and the method according to the present disclosure are described in greater detail below, with reference to the appended drawings, wherein.

DETAILED DESCRIPTION

Figure 1B:
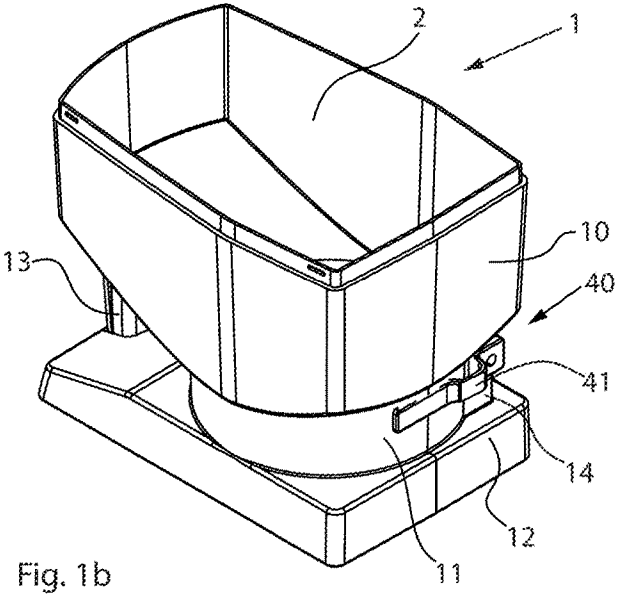
FIG. 1*b* is another perspective view of the storage container of FIG. 1*a;*

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Typical storage and delivery stations for delivering one or more individual drug portions are controlled for assembling the drug portions. During control of a storage and delivery station an individual drug portion is separated out by a separating device and is transferred via a delivery opening to a guiding device of an automatic blister packaging machine. A delivered drug portion is fed using a guiding device, optionally via a collecting device, to a packaging device, which blister-packs individual or multiple drug portions according to a doctor's prescription.

For separating out the drug portions stored in a storage container of a storage and delivery station, a separating device includes a rotor with multiple channels that are usually disposed on the external circumference of the rotor. The channels are usually adapted in terms of their dimensions to the drug portions to be separated out in each case in such a way that in a channel the drug portions can be disposed only one above the other, but not adjacent to one another. The channels are typically designed so that only one drug portion is located in this space.

For delivering a drug portion from a channel, a channel is moved over a delivery opening in the housing of the storage container, and the drug portion disposed in the channel slides or falls into the delivery opening. In order to prevent further drug portions disposed above the channel from also being delivered, a retaining section of a retainer is guided at least over the channel that is aligned with the delivery opening in the region above the delivery opening. In order to ensure that, during delivery of the drug portions, no further drug portions enter the channel, the retaining section is guided only slightly above the plane, which is formed by the upper faces of the projections separating the channels.

In typical storage containers, the retaining section of the retainer is planar, so that, depending upon the form of the drug portions, it is possible that one or more drug portions remain lying on the retaining section and cannot be delivered. If a number of X drug portions are stored in a storage container, in typical storage containers it may happen that only X−Y (Y=number of drug portions lying on the retainer) can be delivered if care is not taken to ensure that the drug portions resting on the retaining section are removed therefrom.

When refilling drug portions, it should be ensured that the storage container no longer contains drug portions, since even mixing different batches of the same type of drug must be avoided. Practically, the procedure is such that the storage container is taken off, shaken for removal of drug portions from the retaining section, and then it is replaced. In this way, it can be ensured that all the drug portions from the storage container can be delivered.

The storage container according to the present disclosure for a storage and delivery station includes a housing surrounding a receiving chamber for drug portions, the housing having a circular cylindrical section and a base surface. The base surface has a delivery opening through which separated drug portions are delivered to a guiding device, for example. A delivery channel may be disposed between the delivery opening and the guiding device.

A separating device may have multiple spaced projections, and channels formed between the projections (e.g., one channel between any two projections), to receive drug portions. The separating device may be rotatably disposed in the circular cylindrical section of the housing, wherein each projection has a surface adjacent to the receiving chamber for drug portions. The uppermost points of the surfaces of the projections may define an upper receiver boundary plane. The receiving chamber for storing the drug portions may be located above this receiver boundary plane, and the channels of the separating device open below the receiver boundary plane.

The storage container may further include a retainer with a fastening section and a retaining section, wherein the retaining section may be held above the delivery opening and above the receiver boundary plane. Thus, entry of the drug portions into a channel aligned with the delivery opening is prevented. In other words, the retaining section of the retainer may always be disposed above the projections between which the channels extend. The storage container may further include a cam for removing drug portions from the retaining section. The cam may be movable above the receiver boundary plane over the retaining section. With the aid of this cam that is movable over the retaining section, drug portions lying on the retaining section may be removed. Thus the at least one cam ensures that all the drug portions introduced into the storage container are delivered. Here, a situation is reliably avoided in which an unknown number of drug portions remains on the retaining section and a delivery of a drug portion is no longer possible, even though not all of the drug portions in the storage container have been delivered. The "shaking" of the storage container is no longer necessary. Thus, the storage container according to the present disclosure considerably reduces the cost of operating an automatic blister packaging machine for a user.

The cam may be moved over the retaining section by a rotary movement of the separating device in the circular cylindrical section of the housing above the receiver boundary plane. At least one cam may be disposed on the external circumference of a central part of the separating device (e.g., the cam moves simultaneously with the channels and projections). If only one cam is provided, the cam may be guided or moved with each revolution of the separating device in one pass over the retaining section for removal of any drug portions lying thereon. Thus, the at least one cam may be a component of the separating device, wherein the at least one cam may be integral (e.g., designed in one piece) with the separating device, or the cam may be attached to the separating device.

In order to prevent drug portions from remaining on the cam itself, and in order additionally to ensure a smooth removal of the drug portions from the retaining section of the retainer, the at least one cam may have a non-planar surface and/or angled radial end faces that converge conically upwards.

The cam may be a component of the separating device. The at least one cam may also not be directly connected to the separating device. Above the channels, the separating device may have a coaxial recess in which at least one cam designed as a rolling element is disposed. This rolling element may also be guided by the rotary movement of the separating device. During such guiding, the rolling element may remove drug portions located on the retaining section, since the rotary movement of the separating device moves the rolling element over the retaining section itself. The rolling element may be spherical, barrel-shaped or roller-shaped, wherein the recess may optionally be adapted to the precise configuration of the rolling element. For example, if the rolling element is configured as a roller, the recess can be designed as a coaxial annular gap in which the rolling element formed as a roller is guided. The annular gap may be delimited towards the exterior for example by the circular cylindrical section of the housing. The internal delimitation may be provided by a likewise circular cylindrical section of the separating device.

In order to simplify the movement of the cam over the retaining section of the retainer, the retainer may be flattened on its radial end faces. The channels of the separating device may be dimensioned so that two drug portions cannot be disposed adjacent to one another in a channel. The vertical dimensioning may be likewise such that there is only space in the channel for one drug portion. Accordingly, the channels may have to be adapted according to the dimensions of the drug portions.

Figure 1D:
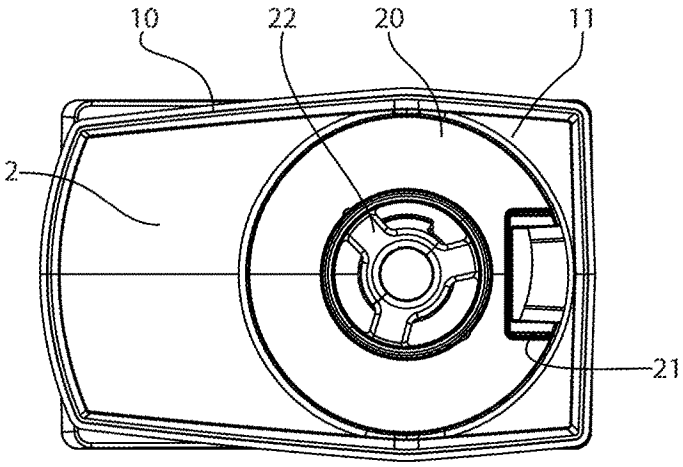
FIG. 1*d* is a top plan view of the storage container of FIG. 1*a* with a separating device removed.
Figure 1A:
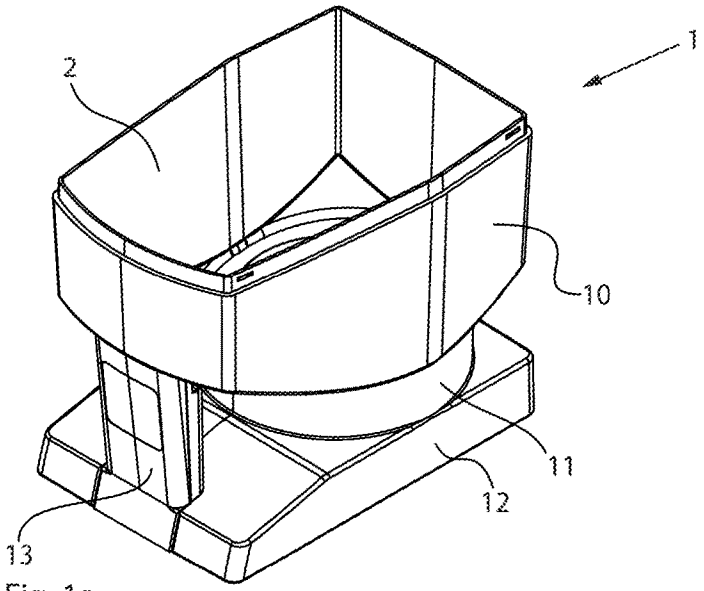
FIG. 1*a* is a perspective view of one or more embodiments of a storage container.
Figure 1C:
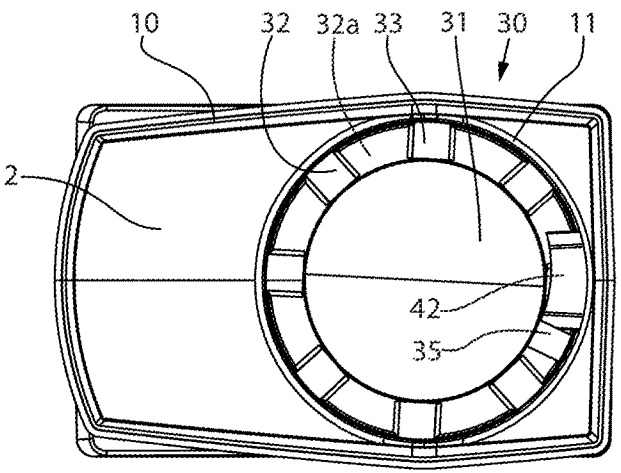
FIG. 1*c* is a top plan view of the storage container of FIG. 1*a;*

FIGS. 1*a* and 1*b* show two oblique views of a storage and delivery station. FIGS. 1*c* and 1*d* show plan views of the storage container. In FIG. 1*d*, a separating device 30, which is indicated in drawings 1*a*-1*c*, is omitted. In all the representations of the storage container, a cover is omitted for a better overall view.

The storage container 1 may include a housing 10 that surrounds a receiving chamber 2 for drug portions. The housing 10 may have a circular cylindrical section 11 in a lower section. The housing 10 may be delimited towards the bottom by a base surface 20 having a delivery opening 21 (see FIG. 1*d*). The base surface 20 may have a further central receptacle 22 that cooperates with a separating device 30. As can be seen from FIG. 1*c*, the separating device 30 may be disposed in the circular cylindrical section 11 of the housing 10 and may include multiple channels 33, each channel 33 configured to receive a drug portion. The channels 33 may be formed by projections 32, each projection 32 having a surface 32*a*. The projections 32 together with a central part 31 may form a rotor, which may be moved by a drive (not shown). The projections 32 may be integral (e.g., designed in one piece) with the central part 31. The projections 32 may also be separate components attached to the external circumference of the central part 31. In either case, the channels 33 may be disposed on the external circumference of the central part 31. As can be seen in particular in FIG. 1*b*, the circular cylindrical section 11 of the housing 10 may include a projection 14, to which a retainer 40 may be fixed by a fastening portion 41. The retainer may further include a retaining section 42, which may be guided into the region of the separating device 30 via a slot in the circular cylindrical section 11.

A storage and delivery station may include the storage container 1 and components that adjust or control the delivery or separation of the drug portions. Such components may be a motor for moving the separating device 30, as well as a sensor for verifying the delivery of a drug portion. The aforementioned further components may be disposed in a base housing 12. However, the storage and dispensing station may be constructed from two main components, a storage container 1 and a delivery device (not shown), wherein the storage container 1 may be fitted detachably onto the delivery device. The storage container 1 may only be removed for filling or cleaning. A handle 13 may be provided in the front region of the storage container 1 in order to better manipulate the storage and delivery station (or optionally only the storage container).

Figure 2B:
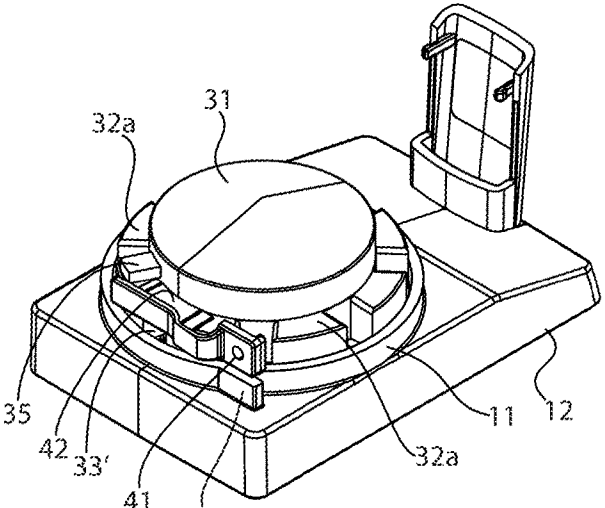
FIGS. 2*a*-2*c* are sectional perspective views of the storage container of FIG. 1*a;*
Figure 2C:
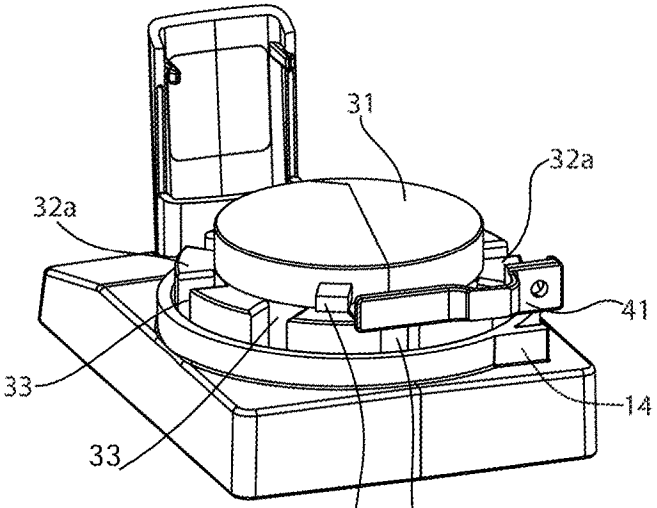
Figure 2A:
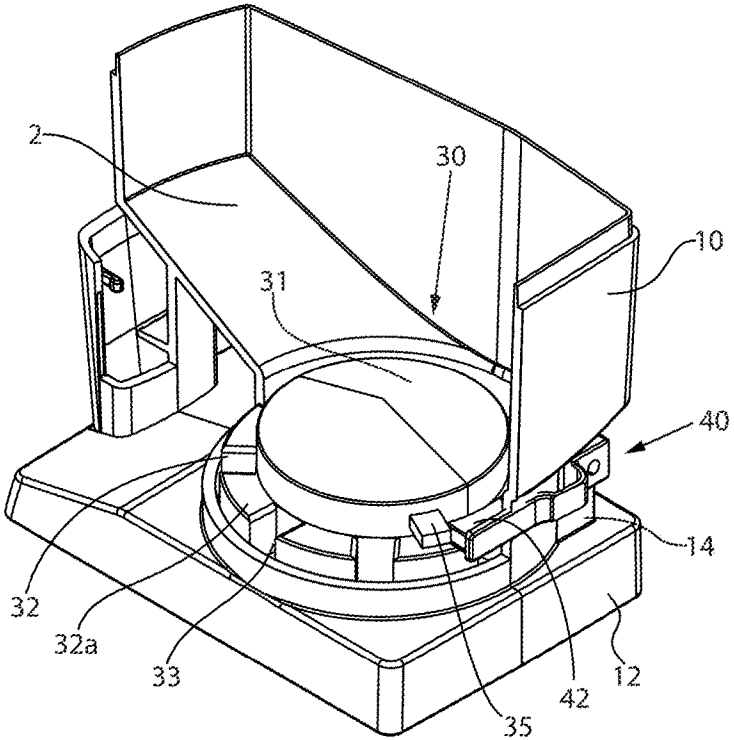

FIG. 2*a* shows a lateral partial sectional view of the storage container 1 of the storage and dispensing station. Here, the housing 10, as well as part of the circular cylindrical section 11, are cut away so that the view of the central separating device 30 is visible. The separating device 30 may include a central part 31. On the outer circumference or generated surface of the separating device 30, multiple projections 32 having a surface 32*a* may be disposed. The arrangement and configuration of these projections 32 on the circumference of the central part 31 may define multiple channels 33. Each channel may be configured so that only one drug portion can be received from a channel 33. The surfaces 32*a* of the projections 32 may define an upper receiver boundary plane AE (indicated graphically in FIG. 3*c* and FIG. 4), via which a retaining section 42 of the retainer 40 may be guided. The retaining section 42 may be introduced via a slot in the circular cylindrical section 11, namely in such a way that the retaining section 42 is disposed above the receiver boundary plane AE.

A cam 35 may be disposed on the external circumference of the central part 31 of the separating device 30 in such a way that a horizontal slot or gap is formed between the underside of the cam 35 and the receiver boundary plane AE. The retaining section 42 of the retainer 40 may be configured to be guided in and through the slot.

FIGS. 2*b* and 2*c* show different views of a partial sectional view of the storage container 1 in which the housing 10 and a part of the circular cylindrical section 11 are cut away, so that the separating device 30 and the arrangement thereof in the circular cylindrical section 11 of the housing can be seen. As already described with reference to FIG. 2*a*, the projections 32 may include a surface 32*a*, wherein the surfaces may define a receiver boundary plane AE (see FIGS. 3*c*, 4). The projections 32 may define the channels 33, wherein the channel 33' illustrated at the front in the drawings is aligned with the delivery opening 21 (not shown here). The retaining section 42 of the retainer 40 may cover the channel 33' from above, so that no further drug portions can enter the channel 33' aligned with the delivery opening 21. During rotation of the separating device 30, the cam 35 may move based on the direction of rotation of the separating device 30 over the retaining section 42, and optionally drug portions lying thereon may be removed by the movement of the cam 35.

Figure 3B:
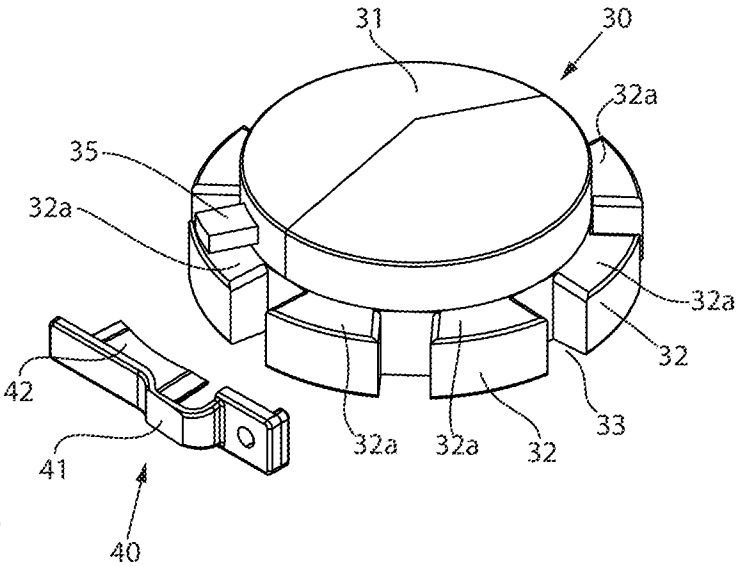
FIG. 3*b* is an exploded perspective view of the separating device and retainer of FIG. 3*a;*
Figure 3A:
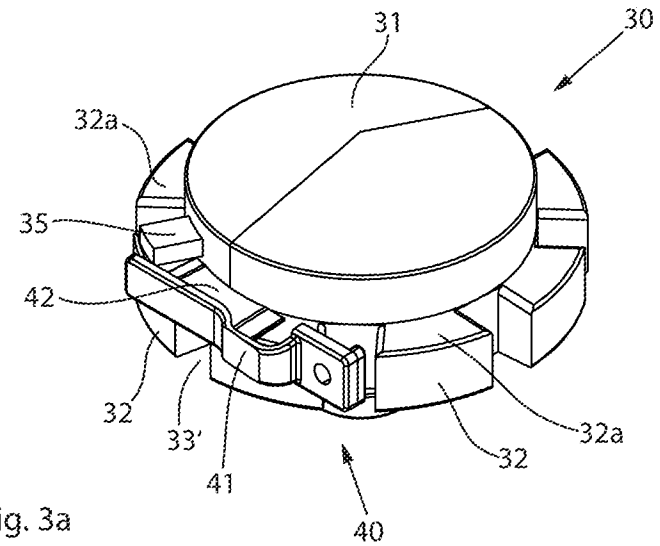
FIG. 3*a* is a perspective view of a separating device and a retainer of the storage container of FIG. 1*a;*

FIGS. 3*a* and 3*b* show details of the separating device 30 and the retainer 40. In FIG. 3*b*, the separating device 30 and the retainer 40 are shown separately from one another. As can be seen, the retaining section 42 of the retainer 40 may be disposed above the receiver boundary plane AE formed by the surfaces 32*a* of the projections 30. The cam 35, which may be disposed on the external circumference of the central part 31 of the separating device 30, may be further disposed in such a way that during a movement of the separating device 30 the cam 35 is moved over the upper surface of the retaining section 42 for removal of drug portions lying thereon.

Figure 3C:
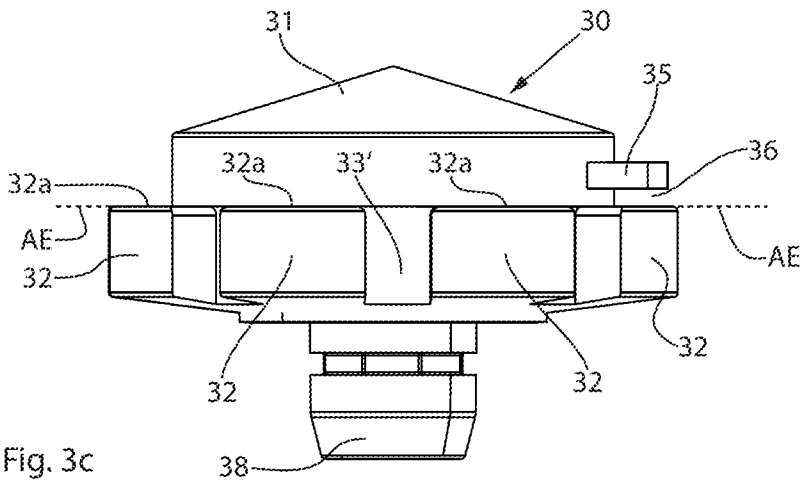
FIG. 3*c* is front elevation view of the separating device and retainer of FIG. 3*a;*

FIG. 3*c* shows a front view of the separating device 30 in which the receiver boundary plane AE is indicated by two broken lines. As can be seen in FIG. 3*d*, the receiver boundary plane AE is defined by the surfaces 32*a* of the projections 32. Here, the surfaces 32*a* of the projections 32 are planar. It is also conceivable that the surfaces 32*a* may be spherical or conical, for example. In this case, the uppermost points of the surfaces 32*a* may define the receiver boundary plane AE.

The retaining section 42 (not shown in FIGS. 3*c*, 4) of the retainer 40 may be guided over the receiver boundary plane AE, so that rotation of the separating device 30 is possible. Above the surface of the retaining section 42, and thus also above the receiver boundary plane AE, the cam 35 may be disposed at the external circumference of the central part 31 of the separating device 30. An intermediate space 36, which can be seen in FIG. 3*c*, may receive the retaining section 42 of the retainer 40. The separating device 30 may further include a lower axial projection 38 that may cooperate with the receptacle 22 in a base surface of the storage container 1 to rotate the separating device 30.

Figure 4:
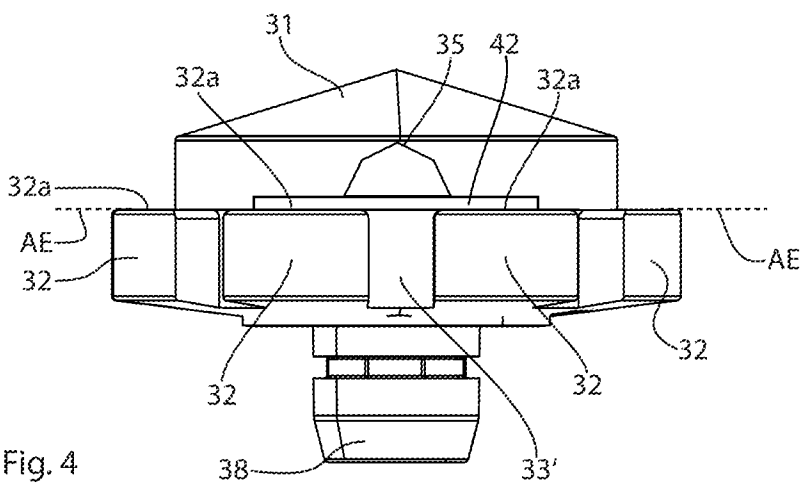
FIG. 4 is a front elevation view one or more embodiments of a separating device.

FIG. 4 shows a storage container having a different configuration of the cam 35. For better illustration of the cam 35 and the arrangement thereof, the fastening section 41 of the fastening means 40 is omitted with only the retaining section 42 being shown in the gap between the cam 35 and the receiver boundary plane AE.

As can be seen in FIG. 4, the surface of the cam 35 may be conical, so that drug portions are prevented from remaining on the surface of the cam 35. Because of the rotary movements of the separating device 30, the probability that a drug portion remains lying on the surface of the cam 35 is in fact limited. However, in the case of a slowly rotating separating device 30 the configuration of the upper face of the cam 35 illustrated in FIG. 4 may be advantageous. Furthermore, the radial end faces of the cam shown in FIG. 4 are not vertical, but protrude obliquely downwards, thus ensuring a smooth moving away of the drug portions from the surface of the retaining section 42. In one or more embodiments, only one design variant may be selected (e.g., a conical upper face or chamfered end faces).

Figure 5A:
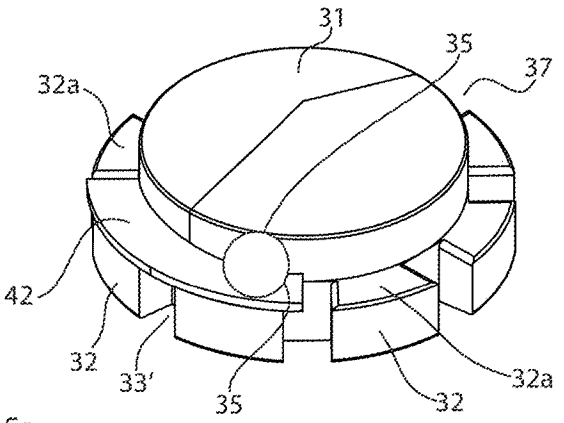
FIG. 5*a* is a perspective view of one or more embodiments of a separating device and retainer.
Figure 5B:
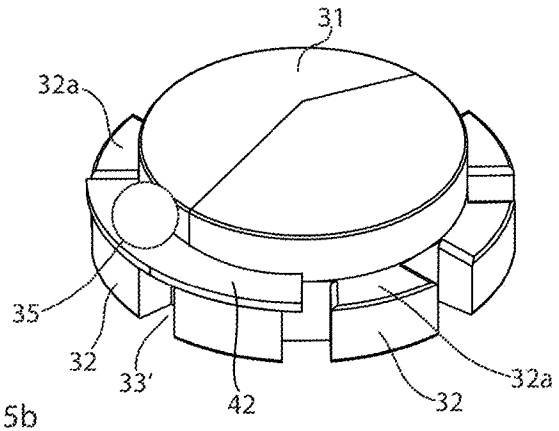
FIG. 5*b* is a perspective view of the separating device and retainer of FIG. 5*a* in a different position.
Figure 5C:
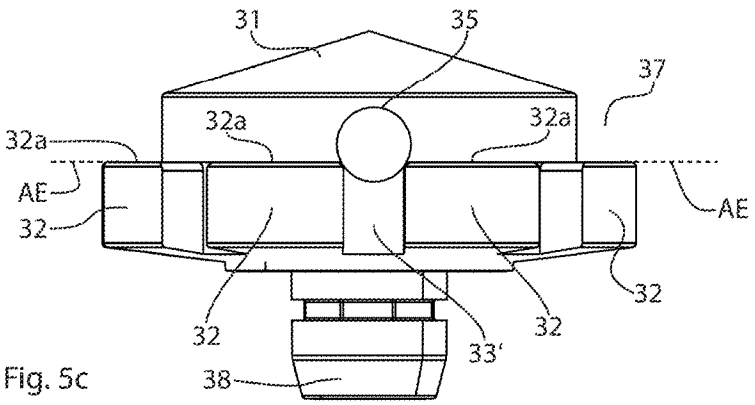
FIG. 5*c* is front elevation view of the separating device and retainer of FIG. 5*a;*
Figure 5D:
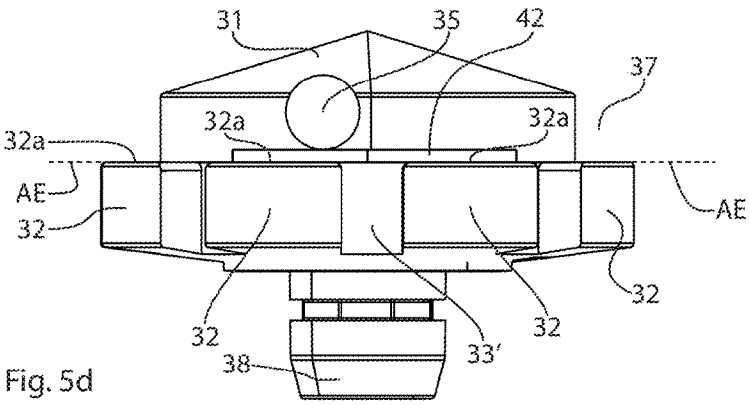
FIG. 5*d* is front elevation view of the separating device and retainer of FIG. 5*b;*

FIGS. 5*a*-5*d* show a storage container 1, wherein FIGS. 5*a* and 5*b* show oblique views and FIGS. 5*c* and 5*d* show front views of the separating device 30 together with the retaining section 42. In FIGS. 5*a*, 5*b* and 5*d* the fastening section 41 of the retainer 40 is again omitted for the sake of clarity.

As can be seen in these drawings, in this embodiment the cam 35 may not be an integral part of the separating device 30 itself, but may be configured as a spherical rolling element disposed in a recess 37 (see in particular FIGS. 5*c*, 5*d*) above the receiver boundary plane AE. Here, the recess 37 is configured as an annular channel. Thus, when the separating device 30 is disposed in the circular cylindrical portion 11 of the housing 10, an annular gap may be formed in which the cam 35 is disposed and in which it is moved by movements of the separating device 30.

In the views illustrated in FIGS. 5*a*-5*d*, the cam 35 is shown in different positions inside the annular groove 37. In FIG. 5*c*, for example, the spherical cam 35 may be disposed in part in an upper channel opening of the channel 33'. In a rotary movement of the separating device 30, the cam 35 may be moved with the channel 33 in the direction of the retainer 40. The retainer 40 may lift the cam 35 from the channel opening, and after the cam 35 has been lifted out of the channel opening, the cam 35 may be moved over the surface of the retaining section 42, so that any drug portions lying on the surface of the retaining section 42 are removed.

Figure 6A:
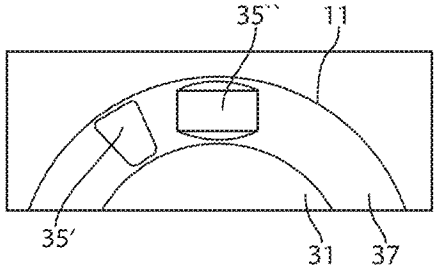
FIG. 6*a* is a portion of a top plan view of one or more embodiments of a separating device and retainer.
Figure 6B:
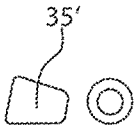
FIG. 6*b* is an exploded front elevation view of one or more embodiments of a cam.
Figure 6C:
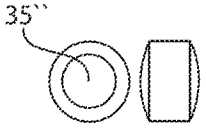
FIG. 6*c* is an exploded front elevation view of one or more embodiments of a cam.

FIGS. 6*a*, 6*b* and 6*c* show the cam 35 configured as a rolling element, wherein the cam 35 is configured in one case as a roller 35" and in one case conically 35'. In FIG. 6*a* the arrangement of the rolling elements in the recess 37 is indicated. FIGS. 6*b* and 6*c* show respectively a side view and a front view of the rolling element.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. A storage container for a storage and delivery station for drug portions, comprising:

a housing defining a receiving chamber for drug portions, the housing comprising a circular cylindrical section and a delivery opening for dispensing the drug portions;

a separating device rotatably disposed in the circular cylindrical section of the housing, the separating device having a plurality of spaced apart projections disposed on an outer axial surface, the spaced apart projections defining channels therebetween to receive the drug portions, wherein uppermost points of adjacent surfaces of the projections define the uppermost point of any of the drug receiving channels on the outer axial surface and an upper receiver boundary plane; and a cam separate from the projections, the cam disposed above the upper receiver boundary plane and above any drug receiving channel on the outer axial surface, the cam configured to remove drug portions from a retaining section of a retainer, the cam having a planar bottom surface parallel to planar top surfaces of the projections, wherein a horizontal gap is disposed between the planar bottom surface of the cam and the upper receiver boundary plane.

2. The storage container of claim 1, wherein the cam is movable above the upper receiver boundary plane over the retaining section.

3. The storage container of claim 1, wherein the retaining section is introduced into the receiving chamber via a slot in the circular cylindrical section.

4. The storage container of claim 3, wherein the retaining section covers a channel aligned with the delivery opening to prevent drug portions from entering the channel.

5. The storage container of claim 1, wherein the cam is disposed on an external circumference of a central part of the separating device.

6. The storage container of claim 1, wherein the retaining section is disposed above the delivery opening and configured to limit entry of the drug portions into a channel aligned with the delivery opening.

7. The storage container of claim 1, wherein the retainer is coupled to the circular cylindrical section of the housing via a projection included in the circular cylindrical section.

8. A storage container for a storage and delivery station for drug portions, comprising:

a housing defining a receiving chamber for drug portions, the housing comprising a circular cylindrical section and a delivery opening for dispensing the drug portions;

a separating device rotatably disposed in the circular cylindrical section of the housing, the separating device having a plurality of spaced apart projections disposed on an axial outer surface, the spaced apart projections defining channels therebetween to receive the drug portions, wherein uppermost points of adjacent surfaces of the projections define the uppermost point of any of the drug receiving channels on the axial outer surface and an upper receiver boundary plane; and a cam separate from the projections, the cam disposed above the upper receiver boundary plane and above any drug receiving channel on the axial outer surface, the cam configured to remove drug portions from a retaining section of a retainer, the cam having a planar bottom surface and at least one angled radial end face.

9. The storage container of claim 8, wherein the cam is movable above the upper receiver boundary plane over the retaining section.

10. The storage container of claim 8, wherein the retaining section is introduced into the receiving chamber via a slot in the circular cylindrical section.

11. The storage container of claim 10, wherein the retaining section covers a channel aligned with the delivery opening to prevent drug portions from entering the channel.

12. The storage container of claim 8, wherein the cam is disposed on an external circumference of a central part of the separating device.

13. The storage container of claim 8, wherein the retaining section is disposed above the delivery opening and configured to limit entry of the drug portions into a channel aligned with the delivery opening.

14. The storage container of claim 8, wherein the retainer is coupled to the circular cylindrical section of the housing via a projection included in the circular cylindrical section.

15. A storage container for a storage and delivery station for drug portions, comprising:

a housing defining a receiving chamber for drug portions, the housing comprising a circular cylindrical section and a delivery opening for dispensing the drug portions;

a separating device rotatably disposed in the circular cylindrical section of the housing, the separating device having a plurality of spaced apart projections disposed on an outer surface and defining channels to receive the drug portions therebetween, wherein uppermost points of adjacent surfaces of the projections define an upper receiver boundary plane; and a cam movably disposed above the upper receiver boundary plane over a retaining section of a retainer, the cam configured to remove drug portions from the retaining section, wherein the retainer is configured to lift the cam from a channel opening.

16. The storage container of claim 15, wherein the cam is a spherical rolling element.

17. The storage container of claim 15, wherein the cam is a barrel-shaped rolling element.

18. The storage container of claim 15, wherein the cam is a roller-shaped rolling element.

19. The storage container of claim 15, wherein the separating device comprises a coaxial recess configured to receive the cam.

* * * * *